US005873311A

United States Patent [19]

Schlattl

[11] Patent Number: 5,873,311

[45] Date of Patent: Feb. 23, 1999

[54] PARTS TRAY FOR USE IN AN OPENED ENGINE COMPARTMENT

[76] Inventor: Alice Schlattl, Osserstrase 1, D-94161 Ruderting, Germany

[21] Appl. No.: 737,116

[22] PCT Filed: Apr. 25, 1995

[86] PCT No.: PCT/DE95/00539

§ 371 Date: Jan. 7, 1997

§ 102(e) Date: Jan. 7, 1997

[87] PCT Pub. No.: WO95/29796

PCT Pub. Date: Nov. 9, 1995

[51] Int. Cl.[6] ..... A47B 23/00

[52] U.S. Cl. ..... 108/44; 248/200.1; 248/298.1

[58] Field of Search ..... 248/424, 163.2, 248/200.1, 202.1, 214, 215, 248.1, 222.11, 222.14, 206.1, 223.41; 108/44, 137, 158, 45, 46, 102, 47; 224/539, 275, 542, 328, 311, 533

[56] References Cited

U.S. PATENT DOCUMENTS

| | | | |
|---|---|---|---|
| D. 371,109 | 6/1996 | Schlattl | D12/425 |
| 690,150 | 12/1901 | Inman | 248/163.2 |
| 2,803,986 | 8/1957 | Choiniere | 359/503 |
| 2,901,303 | 8/1959 | Anderson | 311/21 |
| 2,979,155 | 4/1961 | Scharfenberger | 182/222 |
| 3,522,888 | 8/1970 | Grams et al. | 211/132 |
| 3,698,330 | 10/1972 | Krombach | 108/44 |
| 4,120,250 | 10/1978 | Viessmann | 108/144 |
| 4,811,875 | 3/1989 | DiSimone | 224/42.44 |
| 5,160,026 | 11/1992 | Marsh | 206/373 |
| 5,331,904 | 7/1994 | DiSimone et al. | 108/44 |

FOREIGN PATENT DOCUMENTS 2406728 3/1975 Germany .

*Primary Examiner*—Leslie A. Braun
*Assistant Examiner*—Gwendolyn Baxter
*Attorney, Agent, or Firm*—Hoffman, Wasson & Gitler,P.C.

[57] ABSTRACT

A parts tray for use in the area of an opened engine compartment of a motor vehicle, especially a passenger car, for holding working materials, especially for inspection, maintenance and repair work. When in use the support frame of the parts tray is positioned on the opened engine compartment such that at least one transverse bar extends with its longitudinal extension transversely or perpendicularly to the vehicle axis above the opened engine compartment. On the transverse bar there is at least one receiver or tray. Tools, measuring instruments, printed instructions, drawings, spare parts, etc. can be held by the tray. Several trays may be provided. The support frame has a transverse bar or cross-piece which has a bead-like depression on its periphery in the longitudinal direction. On the bottom of the tray there is then at least one bearing piece with which the tray can be placed on the transverse bar, such that a projection provided on the bearing piece, or elsewhere on the tray, fits into the longitudinal groove of the transverse bar and thus prevents the tray on the transverse bar from tipping.

4 Claims, 9 Drawing Sheets

PARTS TRAY FOR USE IN AN OPENED ENGINE COMPARTMENT

FIELD OF THE INVENTION

The invention relates to a parts tray for use in the area of an opened engine compartment of a motor vehicle, especially a passenger car, for holding working materials, especially for inspection, maintenance and repair work.

BACKGROUND OF THE INVENTION

In repair and maintenance work on motor vehicles, especially passenger cars, in the area of the engine compartment it is common that during this work the aids used, such as tools, measuring instruments, descriptions, plans, spare parts which have been replaced or which are to be replaced, etc. are temporarily placed on the motor or other surface of the engine compartment. This is on the one hand extremely dangerous, since aids forgotten in the engine compartment (for example, tools) can lead to serious damage under certain circumstances, furthermore, by placing aids in the engine compartment there is also the danger that they will fall onto inaccessible or poorly accessible engine locations, necessitating additional time-consuming and expensive work to retrieve them. Furthermore, visible damage cannot be precluded, especially damage to painted or otherwise enhanced surfaces, which is not acceptable in expensive motor vehicles and which dictates time-consuming and costly repairs or improvements.

SUMMARY OF THE INVENTION

The object of the invention is to eliminate this disadvantage and to devise an improved parts tray which can be located with at least one receiver on the engine compartment, in the respective work area, i.e., wherever work, for example inspection, maintenance, repair, etc. is performed.

To achieve this object, a parts tray for use in the area of an opened engine compartment of a motor vehicle, especially a passenger car, for holding working materials, especially for inspection, maintenance and repair work, is designed.

When in use the support frame of the parts tray is positioned on the opened engine compartment such that at least one transverse bar extends with its longitudinal extension transversely or perpendicularly to the vehicle axis above the opened engine compartment. Then, on this transverse bar there is at least one receiver or tray which is formed for example by a shell open on the top. Then the aids required for the respective job, for example, tools, measuring instruments, printed instructions, drawings, spare parts, etc. can be held by this receiver such that the aids can be easily reached by the individual performing the work in the working position. In particular, the worker need not leave the work position. Also the temporary placement of aids on the engine or other surfaces in the engine compartment is no longer necessary.

In one embodiment of the invention the tray is made as such. Then even larger measuring instruments can be deposited on this tray. Furthermore, in this case a shell is provided which preferably forms several compartments which are open on the top and in which the tools, especially special tools, measuring instruments, etc., needed for certain work, together with spare parts, can be accommodated in an orderly manner. In doing so there is also especially the possibility of providing several such trays, of which then each is equipped beforehand with the tools, measuring instruments, spare parts, etc. needed for special work.

Preferably the support frame has a transverse bar or crosspiece which has a bead-like depression on its periphery in the longitudinal direction. On the bottom of the receiver there is then at least one bearing piece with which the tray can be placed on the transverse bar, such that a projection provided on the bearing piece or elsewhere on the tray fits into the longitudinal groove of the transverse bar and thus prevents the tray on the transverse bar from tipping. In this way a very simple arrangement and placement of the receiver or tray on the support frame is possible.

DETAILED DESCRIPTION OF THE DRAWINGS

The invention is detailed below using the Figures on embodiments.

DETAILED DESCRIPTION OF THE PREFERRED EMBODIMENTS

Figure 1:
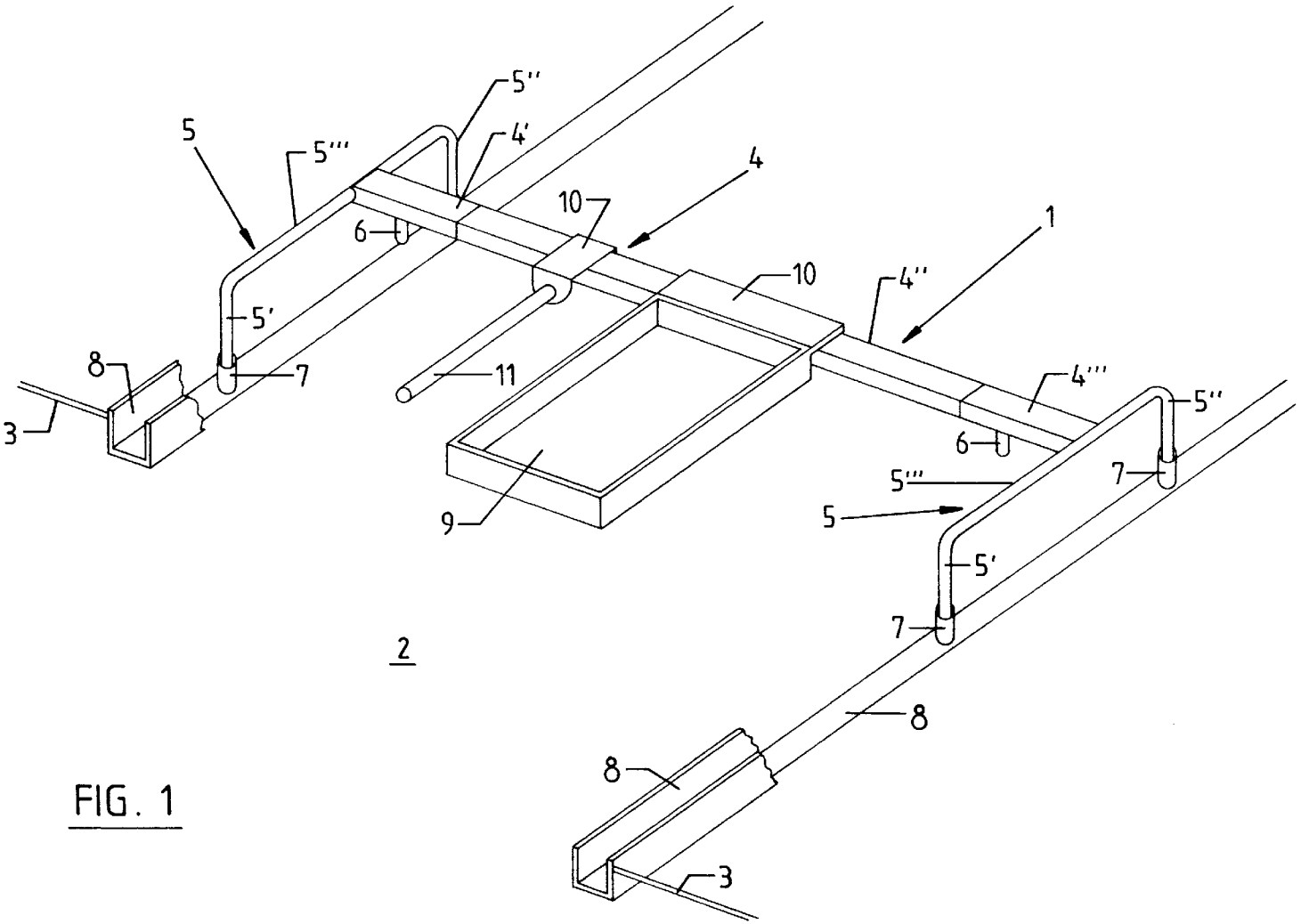
FIG. 1 shows in a simplified perspective representation one embodiment of the holder according to the invention.
Figure 2:
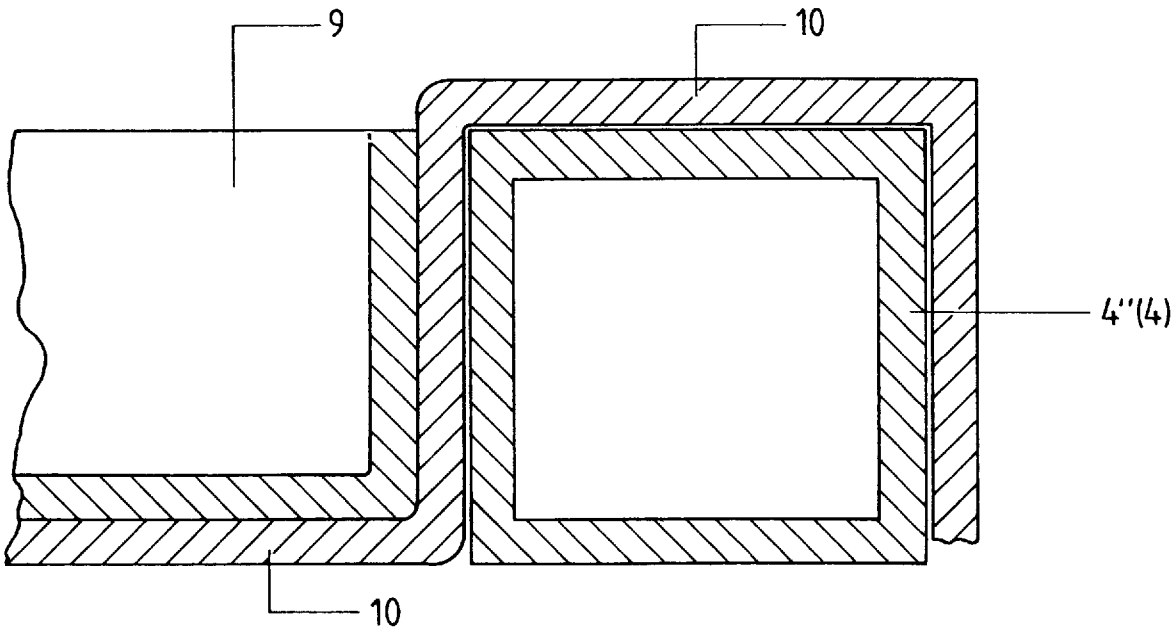
FIG. 2 shows a cross section through the transverse crosspiece of holder according to FIG. 1.
Figure 3:
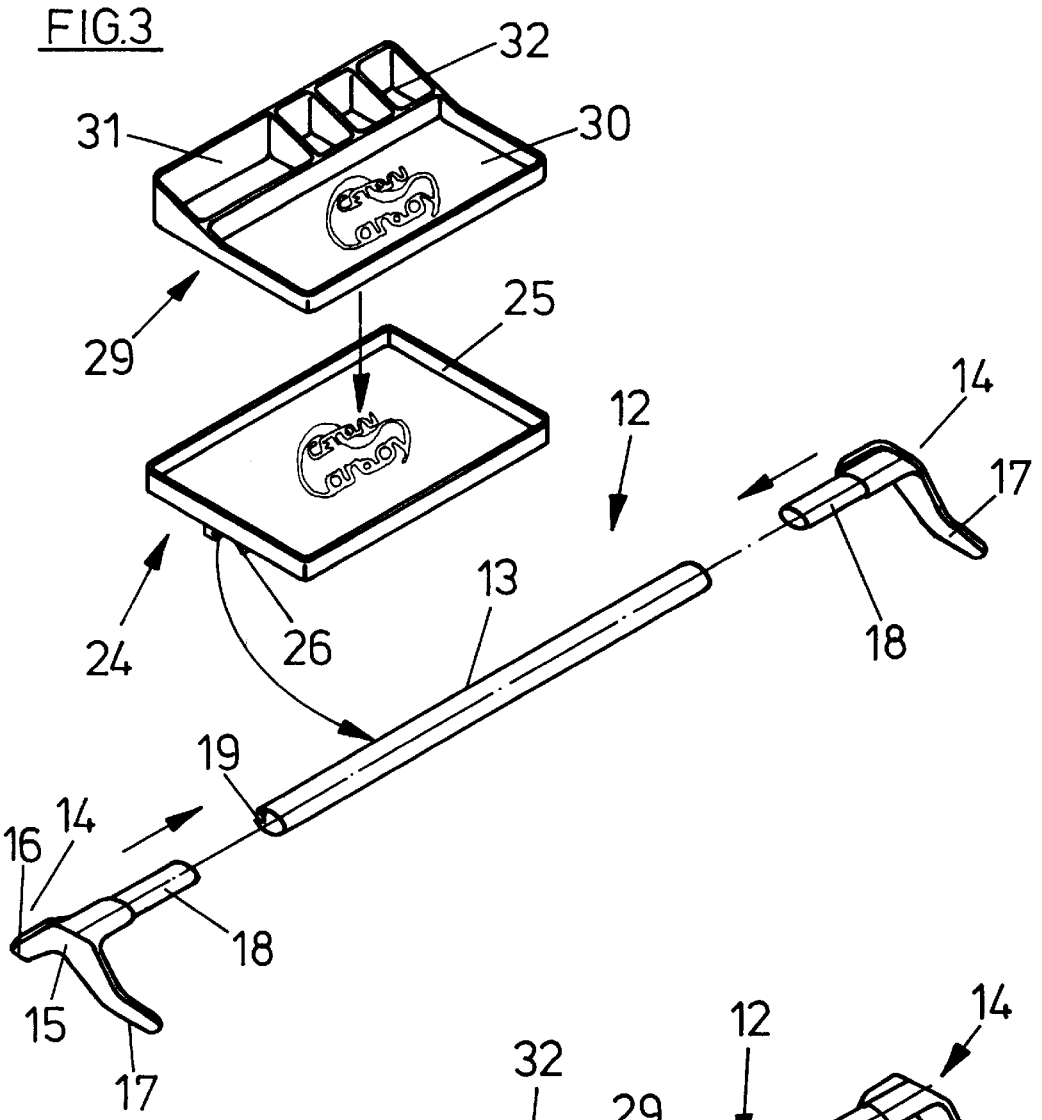
FIG. 3 shows in a perspective exploded view another embodiment of the parts tray according to the invention.
Figure 4:
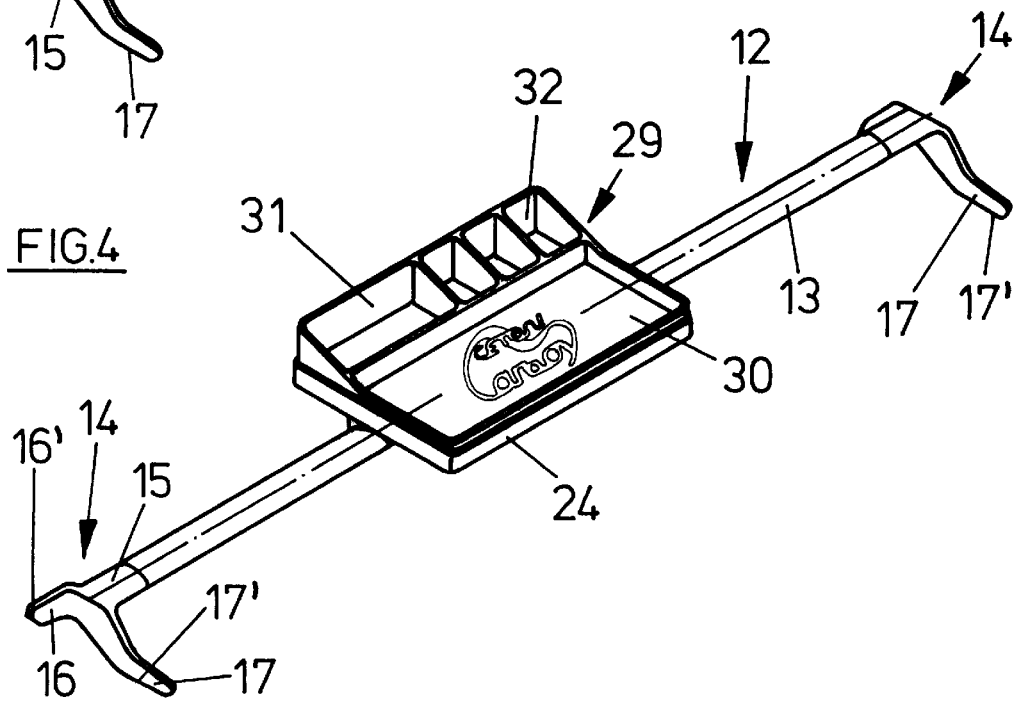
FIG. 4 shows in a perspective view the parts tray of FIG. 3 in use.

The parts tray shown in the figures is used to deposit, hold etc. aids, for example tools, spare parts, drawings, descriptions or instructions, etc. which are necessary in repair and maintenance, especially in the area of engine compartment 2 of a passenger car shown in FIG. 1 only as body 3.

The parts tray consists essentially of support frame 1 with transverse bar which is formed in the embodiment shown by single transverse crosspiece 4, with two stationary or bearing elements 5, one on each end of transverse bar or transverse crosspiece 4. In the embodiment shown bearing elements 5 are each produced from a length of metal section by bending, in a bow- or U-shape with two legs 5' and 5" which to the bottom stand apart from yoke or bow section 5'" which join these legs to one another. Two bearing elements 5 are located with their planes defined by legs 5', 5" and yoke section 5'" when the parts tray is being used in the vertical direction or roughly in the vertical direction and thus transversely to the longitudinal extension of transverse crosspiece 4, such that in the direction parallel to transverse crosspiece 4 corresponding leg 5' and 5" of one bearing element 5 is opposite leg 5' and 5" of other bearing element 5.

In this embodiment the longitudinal extensions of yoke sections 5'" and also the longitudinal extension of transverse crosspiece 4 are in a common plane which is essentially a horizontal plane when the parts tray is in use.

In the same way as bearing elements 5, crosspiece 4 is also produced from one hollow metal section, and in this embodiment from several telescoping sections 4', 4", and 4'" which enable longitudinal adjustment of the transverse crosspiece, and of which center section 4" with the smaller outside cross section extends with its two ends into outside section 4' or 4'".

In the embodiment shown sections 4', 4" and 4'" each have a rectangular inside and outside cross section, the inside cross section of sections 4' and 4'" of course corresponding to the outer cross section of middle section 4".

The respective longitudinal adjustment of transverse crosspiece 4 can be locked or interlocked by clamping or locking means 6. These clamping or locking means 6 are formed for example by at least one clamp screw or by spring or elastic clamping means.

Outer sections 4' and 4'" are each welded to pertinent bearing element 5 or to yoke section 5'" such that the transition between respective section 4' or 4'" and yoke section 5'" is much nearer to rear leg 5" than to front leg 5'.

Preferably transverse crosspiece 4 and bearing element 5 are made of lightweight metal, for example, an aluminum alloy.

Legs 5' and 5" with their lower ends form stationary feet which consist at least on their outer surfaces of an elastic material which has a high friction coefficient, for example, of rubber or a rubber-like plastic. In this embodiment, for this reason sleeves 7 closed underneath and made of the aforementioned material are pushed onto the lower ends of legs 5' and 5".

When in use the parts tray or support frame 1 is placed over the opened engine compartment such that bearing elements 5 with their feet formed by sleeves 7 are inserted from overhead into gutters 8 which are conventionally provided on the two sides which border engine compartment 2 on the longitudinal sides of the vehicle, such that transverse crosspiece 4 in the horizontal direction is transverse to the vehicle axis, and is shifted preferably towards the vehicle interior so far that the repair and working area is located in front of crosspiece 4 when viewed from the front of the vehicle. The parts tray is inserted into the engine compartment especially such that bearing elements 5 point with their legs 5' towards the front of the vehicle.

A shell which consists for example of metal, for example aluminum, but preferably at least partially of plastic, is labelled 9. This tray which in an overhead view of its open top has a rectangular shape is provided on one of its narrow sides with shackle 10 which can be placed on middle section 4" of transverse crosspiece 4 such that this shackle 10 surrounds transverse crosspiece 4 by form-fit and in this way shell 9 is held on one side on crosspiece 4 such that this shell in use extends essentially horizontally away from transverse crosspiece 4, and in the same direction as also the greater lengths of yoke sections 5'" to the front of the vehicle. Shell 9 is used to hold and accommodate tools which are necessary for repair or maintenance. Shell 9 can also be used to hold spare parts and other aids necessary for repair and maintenance.

Of course, there can also be several shells 9 which are used selectively or together on crosspiece 4. Here it is then especially also possible to equip the individual shells individually for different repair and maintenance purposes with tool sets or aids which are required for certain maintenance or repair activities.

In FIG. 1, 11 labels a wall plate which can likewise be removably attached to transverse crosspiece 4 for illumination of the working field and with a shackle or holder corresponding to shackle 10.

In the embodiment shown, the outside surfaces of transverse crosspiece 4 or of middle section 4" in use are in the horizontal plane or essentially in horizontal and vertical planes, i.e., the top and bottom of middle section 4" lie in planes parallel to the aforementioned plane which includes the longitudinal extension of transverse crosspiece and yoke sections 5'".

FIGS. 3–6 show another preferred embodiment of the parts tray according to the invention. In this embodiment it consists of support frame 12 which has rod-like crosspiece 13 which is formed by a tubular hollow section, and has two stationary elements 14 with which the parts tray or support frame 12 can be placed in the same manner as was described for support frame 1, in the area of opened engine compartment 2 transversely to the vehicle, in turn on the surfaces provided laterally from the engine compartment, for example, in the area of gutters 8 there.

Two stationary elements 14 which are made mirror-symmetrically to an imaginary middle plane of support frame 12 which vertically intersects the longitudinal axis of this support frame each consist of head piece 15 with two molded-on legs 16 and 17 which stand apart obliquely to the bottom from head piece 15, and of which the arm located on the back of support frame 12 or on the back of the parts tray is shorter than leg 17 which is pointed to the front. Two legs 16 and 17 in turn form a stationary foot with which the support stands on the surface of the car body which is located laterally to the engine compartment. Longer leg 17 in the area of its end is extended in the manner of a shoe. Both legs each have flat lower stationary surface 16' and 17', stationary surface 17' in the view corresponding to FIG. 6 having a greater length. Legs 16 and 17 are normally in a common plane which runs vertically to the longitudinal extension of crosspiece 13 and they are made like flat levers such that the larger surface sides of these arms lie parallel to the aforementioned plane.

On head piece 15 there is pipe section 18 which stands apart from this head piece and which is located with its longitudinal extension perpendicularly to the aforementioned plane of arms 16 and 17.

Figure 5:
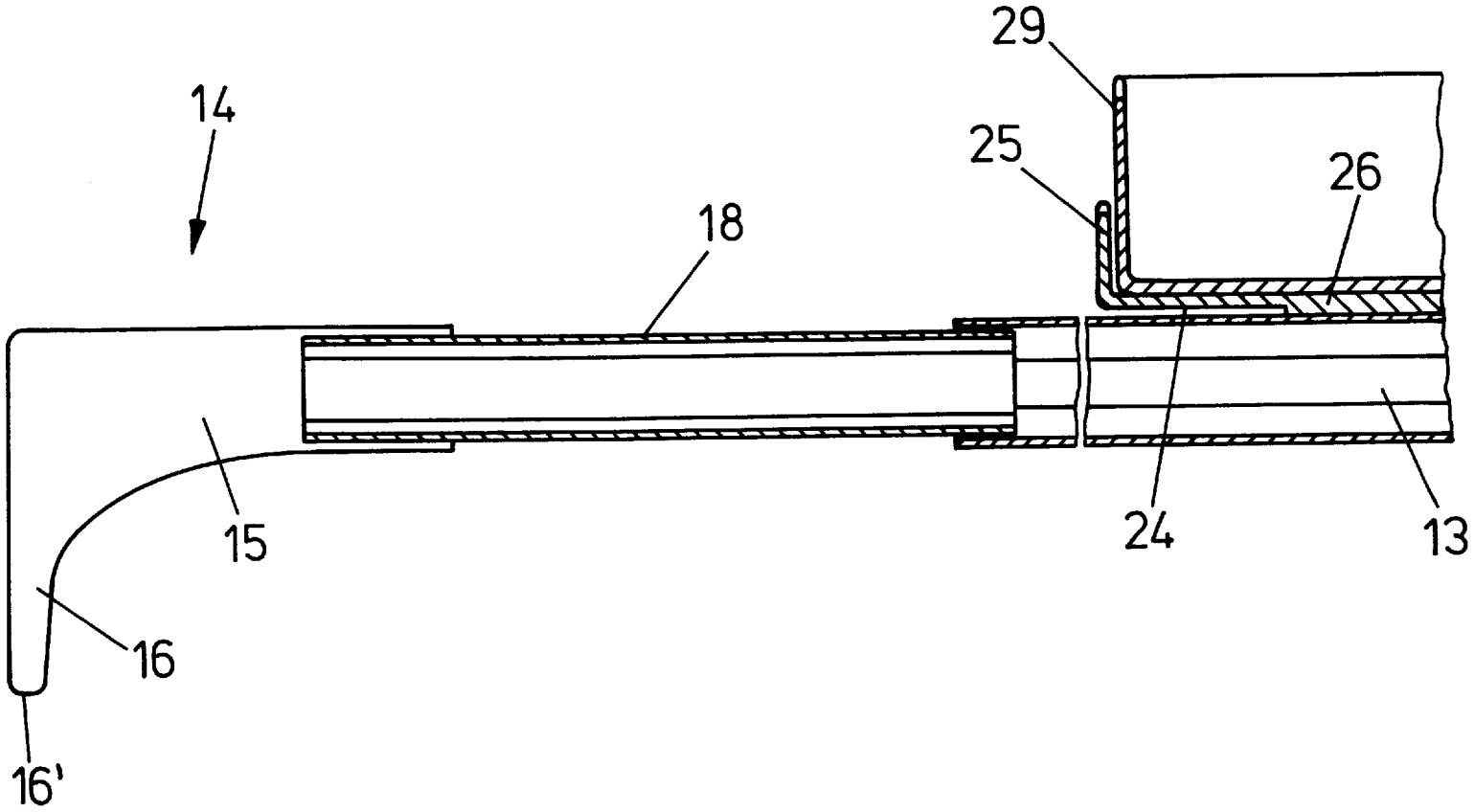
FIG. 5 shows in an enlarged partial view a longitudinal section through the parts tray of FIG. 4.
Figure 6:
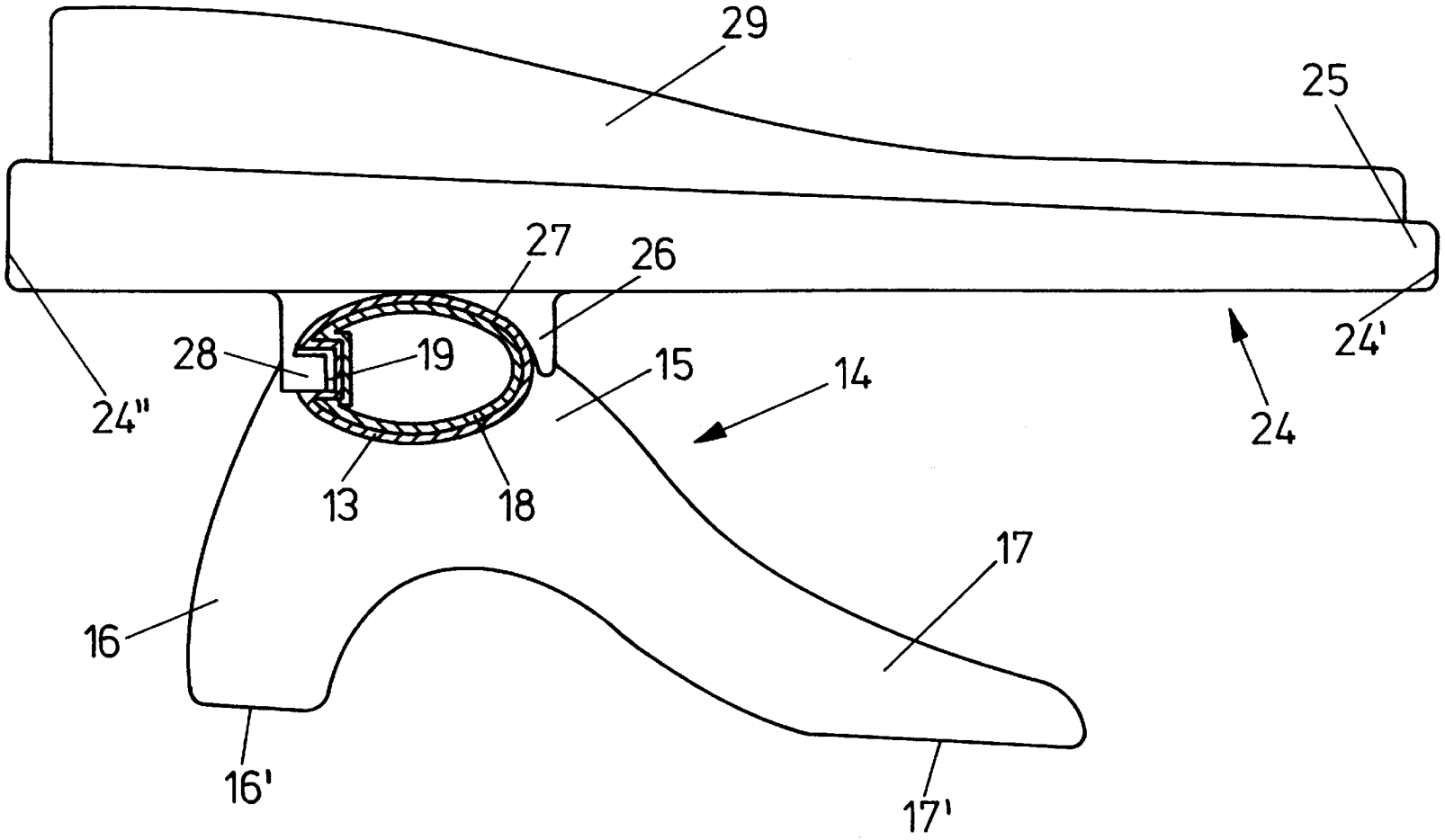
FIG. 6 shows a section corresponding to line I—I of FIG. 5.
Figure 7:
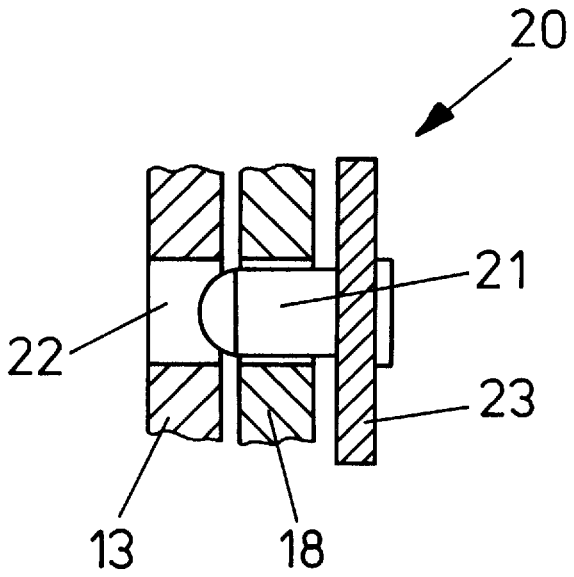
FIG. 7 shows in a simplified view and in cross section a catch for use in the parts tray of FIGS. 3–6.

Head piece 15 is made in one piece with legs 16 and 17 from load-bearing plastic by molding. Pipe section 18 consists of metal, preferably an aluminum alloy, and with its one end is extrusion- coated with the plastic which forms head piece 15 and legs 16 and 17. As especially FIGS. 5 and 6 show, crosspiece 13 consists of a length of a pipe profile of metal, preferably likewise aluminum or an aluminum alloy, this profile of an essentially oval cross section being provided with groove-shaped molding or bead 19 which extends in the longitudinal direction and which extends in the longitudinal direction of crosspiece 13 over the entire length of this crosspiece, in the area of the largest cross section of the oval pipe profile which forms crosspiece 13, and symmetrically to an imaginary plane which includes the larger cross sectional axis and longitudinal axis of crosspiece 13, and which is open only to the outer surface of crosspiece 13 and on both ends of this crosspiece. Pipe section 18 of each stationary element 14 has a cross section matched to the inner cross section of crosspiece 13 such that pipe sections 18 for attaching stationary elements 15 are pushed into one end of crosspiece 13 at a time and are held there by a press fit or spring catch. For this reason, for example in the area of the free end in each pipe section 18 there is elastic catch 20 which can engage opening 22 of crosspiece 13 with catch element 21. As is shown in FIG. 7, catch element 21 consists of a rounded journal which is provided on leaf spring 23 and is arranged such that openings 22 are located in rectangular bead 19, therefore are essentially invisible.

On the ends of crosspiece 13 openings 22 preferably form a series of holes so that by more or less deeply inserting pipe section 18 into crosspiece 13 the length of support frame 12 can be adjusted and thus also this support frame can be matched to the width of engine compartment 2 of the pertinent motor vehicle. Since head piece 15 and legs 16 and 17 of each stationary element 14 consist of plastic which has a certain inherent elasticity, especially legs 16 and 17 can be easily bent by the user, such that the parts tray fits for vehicles of various types.

Pipe sections 18 are held in respective head piece 15 such that the longer cross sectional axis of the oval cross sectional profile of these pipe sections is parallel to roughly parallel to an imaginary plane which runs parallel to the longitudinal extension of pipe sections 18 and which includes stationary surfaces 16' and 17'. In this way crosspiece 13 lies essentially in the horizontal direction with the larger cross sectional axis of its oval cross section when the parts tray is in use.

A tray labelled 24 can be positioned anywhere along crosspiece 13 and in an overhead view has an upper, essentially rectangular support surface or top which is bounded by closed peripheral edge 25 which projects somewhat above the support surface. On the bottom, tray 24 has bearing piece 26 which projects above the bottom and which is essentially a strip-like projection which extends parallel to one of the longer sides of tray 24 and has a shorter distance from one of these longer sides which forms the back of tray 24 than from the other longitudinal side which forms the front of tray 24. The bearing element has gutter-like recess 27 which is open on both ends and to the bottom, which extends over the entire length of this bearing element, and which has a shape matched to the oval outside cross section of crosspiece 13 and accordingly forms a concavely arched bearing surface 27 with which tray 24 or its bearing element 26 is supported on the top of crosspiece 13. As FIG. 6 shows, this bearing surface 27 extends roughly over half the periphery of crosspiece 13 and above the overlying part of the outer surface of this crosspiece. Bearing element 26 furthermore has strip-like projection 28 which extends over the entire length of this bearing element and which projects over bearing surface 27 on its edge adjacent to the back of tray 24 and can be inserted into bead-like depression 19 of crosspiece 13.

Since bearing piece 26 with which tray 24 can be seated on crosspiece 13 like a slide is off-center, i.e., the rear longitudinal side of tray 24 is much nearer than the front longitudinal side and thus also the center of gravity of tray 24 is located between bearing piece 26 and front side 24' of tray 24, tray 24 is reliably secured after being seated on crosspiece 13 by projection 28 which fits into groove 19, especially simple mounting and dismounting of tray 24 on or off crosspiece 13 being possible.

Tools, measuring instruments, handbooks, etc. can be placed on tray 24 during repair and maintenance activities.

A shell labelled 29 can be inserted into tray 24 and forms several compartments which are open on the top of this shell, one larger compartment 30, one medium-sized compartment 31 and three smaller compartments 32, which latter are provided on one longitudinal side of rectangular shell 29 adjacent to one another and adjacent to compartment 30, in the direction to the other longitudinal side of shell 29 behind larger compartment 30.

Shell 29 is used for orderly accommodation and holding of tools, spare parts, measuring instruments, etc. which are needed for certain repairs or maintenance. Before starting this activity, shell 29 is prepared with the corresponding tools, measuring instruments, spare parts or replacement parts, etc; this is done in a larger shop by the tool and spare parts stockroom. After completion of repair and maintenance, shell 29 with the tools, measuring devices, replaced parts, etc. is removed from tray 24 and returned to the shop area provided for tool storage. For example, at that location there is a shelf or cabinet for holding several shells 29, of which each is equipped beforehand with the special tools or measuring devices necessary for this purpose.

Tray 24 and also shell 29 with all their components are produced in one piece from plastic by injection.

Figure 8:
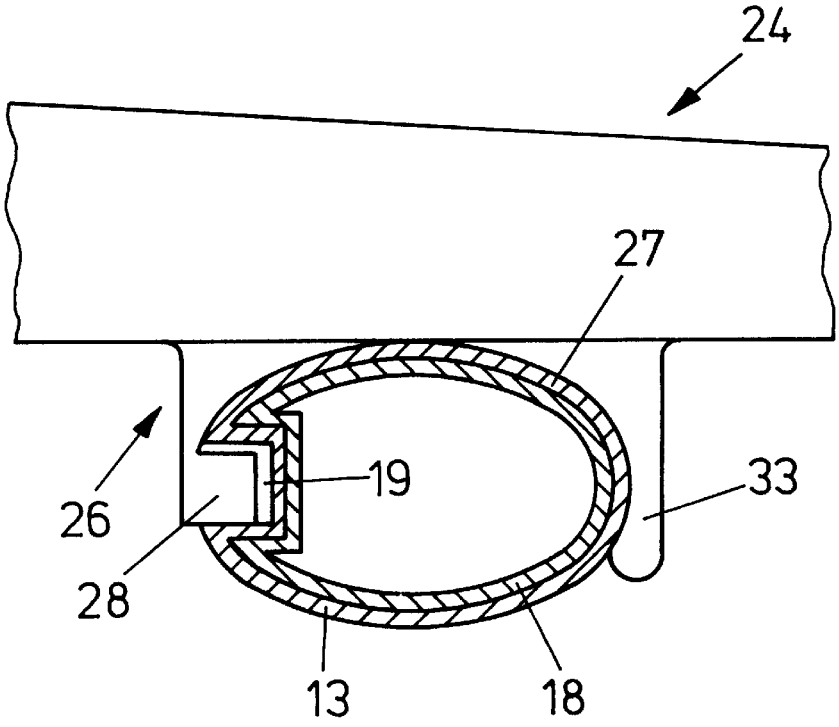
FIG. 8 shows in an enlarged detailed view a section similar to FIG. 6 in another possible embodiment.

FIG. 8 shows in an enlarged sectional view like FIG. 6 another possible embodiment which differs from the embodiment of FIGS. 3 to 7 only in that bearing piece 26 is made on the side opposite projection 28 as clamp or elastic clip 33 which fits behind crosspiece 13 like a clamp or clip with the tray attached to this crosspiece, with which tray 24 is additionally secured.

Figure 9:
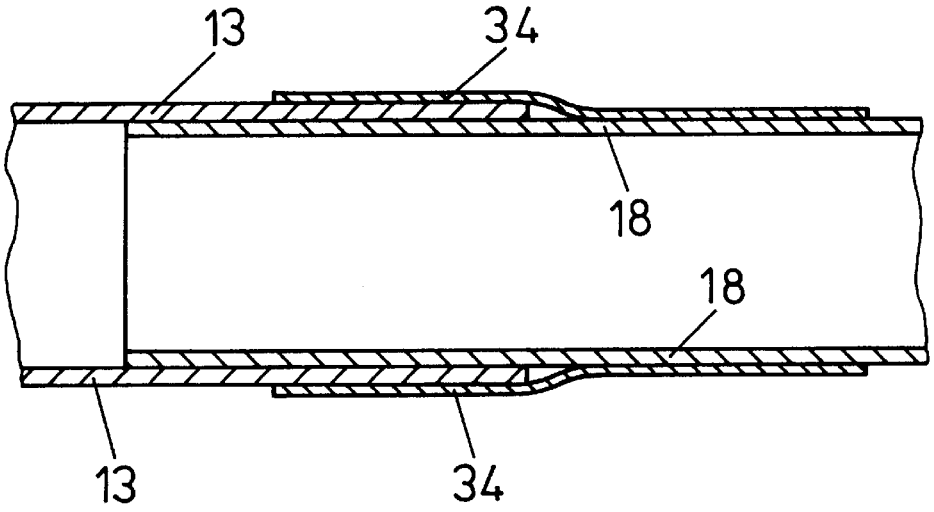
FIG. 9 shows a section through the transverse crosspiece in the area of the transition between the pipe section and this transverse crosspiece for a modified embodiment of the parts tray of FIGS. 3–7.

FIG. 9 shows a section through crosspiece 13 and pipe section 18. As is shown, plastic tube 34 is shrunk onto pipe section 18 and crosspiece 13 so that the transition between crosspiece 13 and pipe section 18 is covered and motion between crosspiece 13 and the pipe section is without play.

Figure 10:
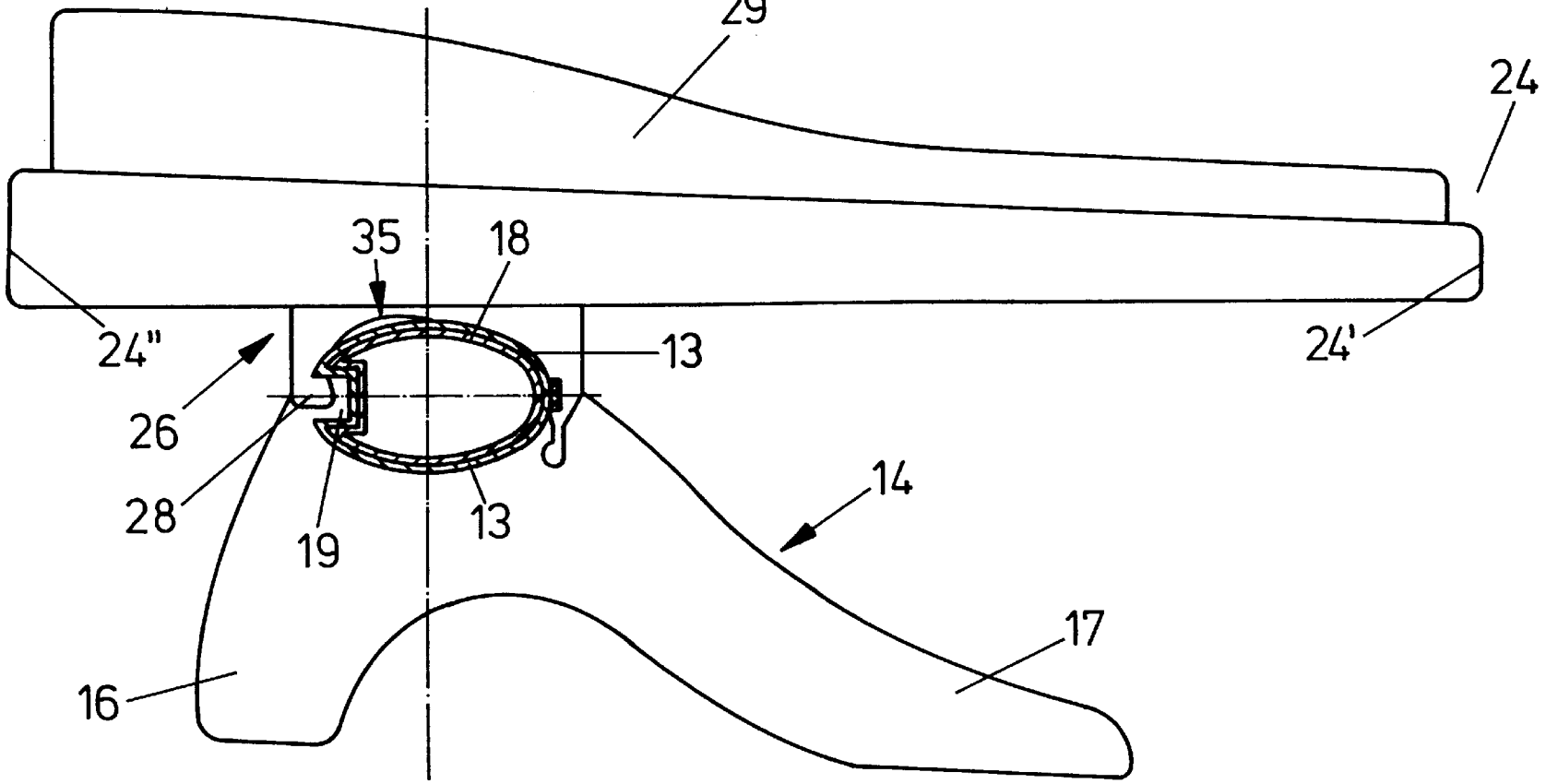
FIGS. 10 and 11 and representations like FIG. 6 in another embodiment of the invention.
Figure 11:
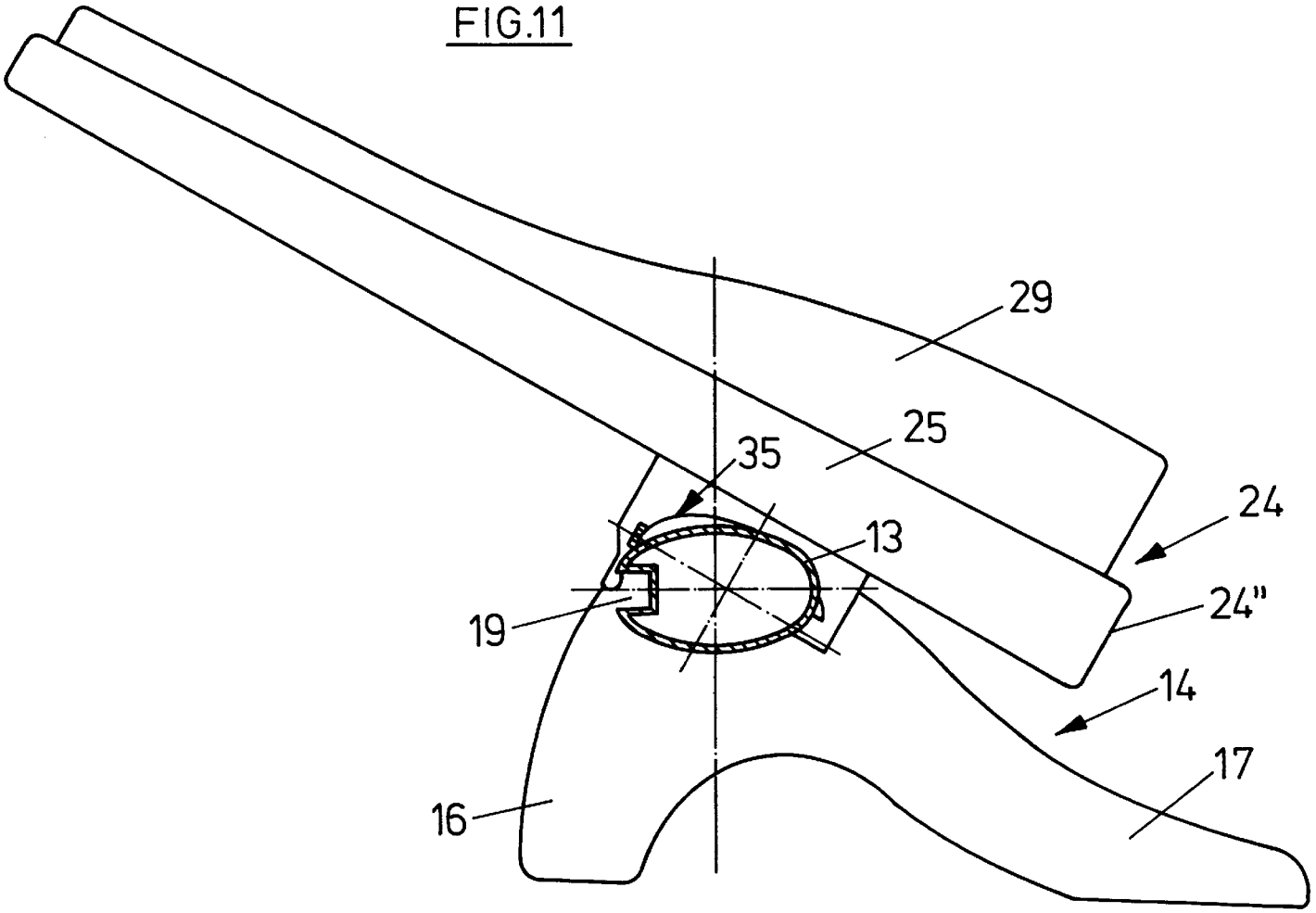

FIGS. 10 and 11 show one embodiment in which tray 24 can also be placed on crosspiece 13 turned, i.e., with rear edge 24" pointing forward, in a sloped position in which edge 24" which points forward is lower than edge 24' which points to the rear. The tray is then used as a rest for operating instructions, etc. which can be especially easily read due to the inclined position. This inclined position is attained by bearing piece 26 forming recess 35 into which crosspiece 13 or the profile which forms it fits exactly in the two positions.

The invention was described above using embodiments. It goes without saying that numerous changes and modifications are possible without departing from the inventive idea of the invention.

Thus, for example, it is possible in particular to provide bearing elements 5 adjustably on transverse crosspiece 4 or to make then inherently adjustable such that adaptation to the run of gutters 8 or another stationary surface is possible for different vehicle types.

Furthermore, it is also possible to provide other operating elements, for example, connectors for connection of electrical devices, etc. on support frame 1 of the parts tray.

Furthermore, it is possible to provide on the passage between crosspiece 4, 13 and bearing element 5, 14 or pipe section 4''', 18 a covering there which optically covers the passage and protects against penetration of dirt and other foreign materials.

I claim:

1. A parts tray for an open engine compartment of a motor vehicle, for holding working materials, comprising a support frame having at least one transverse bar and two bearing elements provided on ends of said transverse bar, said at least one transverse bar and said two bearing elements being movable to a use position transverse to an axis of said vehicle to span said open engine compartment, and at least one tray disposed on said at least one transverse bar, wherein said at least one transverse bar has at least one longitudinal groove, wherein on a bottom of said tray is bearing piece which can be seated on said at least one transverse bar and which fits around said at least one transverse bar, and wherein on one of said at least one tray and said bearing piece there is at least one projection which fits into said longitudinal groove of said at least one transverse bar.

2. The parts tray according to claim 1, wherein said groove is disposed an angular amount relative to a top of said at least one transverse bar.

3. The parts tray according to claim 1, wherein said at least one transverse bar has an oval outside cross section.

4. The parts tray according to claim 1, wherein said at least one transverse bar is formed from a pipe.

* * * * *